US006523822B1

(12) United States Patent
Galtier et al.

(10) Patent No.: US 6,523,822 B1
(45) Date of Patent: Feb. 25, 2003

(54) ALIGNING DEVICE FOR DOCUMENT FEEDER

(75) Inventors: Olivier Galtier, Saint-Fargeau-Ponthierry (FR); Laurent Delfosse, Nogent sur Marne (FR)

(73) Assignee: Neopost Industrie, Bagneux (FR)

( * ) Notice: Subject to any disclaimer, the term of this patent is extended or adjusted under 35 U.S.C. 154(b) by 125 days.

(21) Appl. No.: 09/672,977

(22) Filed: Sep. 29, 2000

(30) Foreign Application Priority Data

Oct. 1, 1999 (FR) ..... 99 12309

(51) Int. Cl.[7] ..... B65H 1/00
(52) U.S. Cl. ..... 271/171; 271/240; 271/223
(58) Field of Search ..... 271/171, 241, 271/220, 223, 250, 251; 414/788.9

(56) References Cited

U.S. PATENT DOCUMENTS

| | | | | | |
|---|---|---|---|---|---|
| 2,905,467 | A | * | 9/1959 | Zahradnik | 271/223 |
| 3,140,090 | A | * | 7/1964 | Winkler et al. | 271/171 |
| 4,022,459 | A | * | 5/1977 | Mather | 271/217 |
| 4,348,249 | A | * | 9/1982 | Denzin | 156/442.2 |
| 4,786,042 | A | * | 11/1988 | Stemmle | 271/127 |
| 4,956,782 | A | | 9/1990 | Freeman et al. | |
| 5,143,363 | A | * | 9/1992 | Irie et al. | 271/223 |
| 5,203,263 | A | | 4/1993 | Berger et al. | |
| 5,215,302 | A | | 6/1993 | Bedzyk | |
| 5,297,787 | A | * | 3/1994 | Shirai | 271/171 |
| 5,628,504 | A | * | 5/1997 | Lyga | 271/171 |
| 6,361,042 | B1 | * | 3/2002 | Shimura et al. | 271/221 |

FOREIGN PATENT DOCUMENTS

| | | | | |
|---|---|---|---|---|
| GB | 2146626 | * | 3/1985 | 271/171 |
| GB | 2 146 626 A | | 4/1985 | |
| JP | 0131642 | * | 8/1982 | 271/171 |
| JP | 66030 | * | 3/1988 | 271/171 |
| JP | 03 162 371 A | | 7/1991 | |
| JP | 404112152 | * | 4/1992 | 271/171 |
| LU | 82 788 A | | 9/1980 | |

* cited by examiner

*Primary Examiner*—Christopher P. Ellis
*Assistant Examiner*—Richard Ridley
(74) *Attorney, Agent, or Firm*—Sughrue Mion, PLLC

(57) ABSTRACT

This invention relates to an aligning device for a feeder of a mailing machine, comprising a first rear aligning guide mobile in one direction of advance of the mailpieces and a second lateral aligning guide mobile in a direction perpendicular to this direction of advance, each aligning guide being adapted to be displaced in a respective groove. The groove associated with the rear aligning guide is inclined by a determined angle $\alpha$ with respect to the direction of advance of the mailpieces, with the result that the rear aligning guide remains substantially centered on the small dimension of the mailpiece whatever the format of this piece. The rear aligning guide preferably presents the shape of a wedge having at least two successive slopes, a first slope of slight inclination and a second slope of steep inclination.

15 Claims, 3 Drawing Sheets

ALIGNING DEVICE FOR DOCUMENT FEEDER

FIELD OF THE INVENTION

The present invention relates exclusively to the field of mailing systems and more particularly to document feeders.

BACKGROUND OF THE INVENTION

Modules for feeding mailing machines, or feeders, are well known. In addition to the rollers for selecting and gripping documents and the conveyor rollers, such feeders all comprise a system for ensuring suitable positioning of the mailpieces with a view to being gripped by the document selection and gripping rollers. Such positioning may be effected via the rear of the mailpiece, as disclosed in U.S. Pat. No. 5,203,263 to ASCOM and in which FIG. 1 illustrates a rear aligning device, or wedge, 16. It may also be effected from the side. U.S. Pat. No. 4,956,782 to PITNEY BOWES discloses a mailing assembly of which the feeder module comprises a lateral aligning device, or guide, 53 to apply the mailpieces against a registration wall 59.

These lateral and rear aligning devices used alone in the afore-mentioned documents might very certainly also be used in combination to guide the mailpieces more precisely, in particular towards a franking station in the mailing machine disposed downstream of the feeder.

The rear aligning device generally slides in a longitudinal groove parallel to the direction of advance of the mailpieces, while the lateral aligning device generally slides in a transverse groove perpendicularly to said direction of advance and to the wall for registration of these pieces.

However, neither of these solutions takes into account the different formats of mailpieces capable of being positioned and guided in a conventional feeder module. Now, such positioning is particularly delicate, as:

- for large formats, the zone of contact between pieces and aligning device may be considerably off-centred with respect to these pieces; this may falsify the alignment of these pieces with respect to the registration wall,
- for small formats, the lateral aligning device tends to abut on the rear aligning device without being able suitably to perform its function of aligning; in effect, taking into account the longitudinal groove, the rear aligning device requires a certain space necessary for efficient guiding and decollation, which is generally incompatible with the smallest formats.

In addition, with the increasing development of digital franking machines, particularly employing ink jet, the crucial problem is raised of the highly precise positioning of the mailpiece in order to obtain a print of sufficient quality, any defective positioning and/or guiding in the feeder module running the considerable risk of the franking station printing indicia of unacceptable monetary quality.

It is an object of the present invention to provide an aligning device for a document feeder in a mailing machine, which allows a suitable aligning of the mailpieces of small and large formats, with rear and lateral aligning elements of reduced size. Another object of the invention is to effect such positioning rapidly and facilitating extraction of the lower pieces (with respect to a stack of mailpieces). A further object of the invention is to make it possible to take into account mailpieces of large, non-standard formats, in particular of a format larger than the width of the feeder.

SUMMARY OF THE INVENTION

These objects are achieved by an aligning device for a feeder of a mailing machine, comprising a first rear aligning guide mobile in a direction of advance of the mailpieces and a second lateral aligning guide mobile in a direction perpendicular to this direction of advance, each aligning guide being displaceable in a respective groove, characterized in that the groove associated with said rear aligning guide is inclined by a determined angle $\alpha$ with respect to said direction of advance of the mailpieces, with the result that said rear aligning guide remains substantially centred on the mailpiece whatever the format of this piece.

In this way, off-centering of the rear guide for the large-format mailpieces is avoided and it becomes possible to align the small- and large-format pieces suitably in median zone.

According to a preferred embodiment, the rear aligning guide presents the form of a wedge comprising at least two successive slopes, a first slope of slight inclination and a second slope of steep inclination, and preferably presenting three slopes with an additional slope of average intermediate inclination. The first slope of slight inclination ensures support of the mailpieces while the second slope of steep inclination facilitates the extraction one by one (singulation) of these pieces.

The rear aligning guide may advantageously also comprise a mark intended to be aligned with one of a plurality of marks previously engraved on the tray for receiving the mailpieces and each corresponding to a standard format of mailpieces. Thanks to such marking, it is thus possible to ensure rapid positioning of the rear guide as a function of the stack of mailpieces having to be positioned on the tray. It may also comprise two gauge labels marking two determined threshold thicknesses of the mailpieces each corresponding to a determined operation of adjustment of the feeder. By this configuration of marking, a simple visual detection of thickness with respect to these two marked thresholds is sufficient to adjust this feeder in order to process batches of mailpieces of the corresponding range of thicknesses.

According to a preferred embodiment, the rear aligning guide comprises a lower longitudinal member provided with at least one elastic element intended to cooperate with a cavity made in the longitudinal groove, so as to define a position of stop for this guide.

The lateral aligning guide advantageously slides in the lateral groove associated therewith via a slideway. With this structure, it is possible to align mailpieces whose dimensions in width are greater than that of the tray for receiving these pieces.

The lateral aligning guide comprises a lower longitudinal member provided with at least one first elastic element adapted to cooperate with a cavity made in said slideway, so as to define a position of stop for this guide, and the slideway is provided with at least one second elastic element adapted to cooperate with a cavity made in the transverse groove, so as to define a position of stop for this slideway.

In order to allow a differential displacement of the slideway and of the longitudinal member, the elasticity of the second elastic element is less than that of the first elastic element.

According to a particular form of embodiment, the lateral aligning guide may comprise a system for automatically adjusting its positioning, as a function of the width of the mailpiece, comprising at least one position and/or pressure sensor fixed on an end part of the lateral aligning guide in order to control displacement of a drive motor under the action of a control circuit. Alternately, this automatic adjusting system may also comprise a system of calibrated springs in order to maintain a substantially constant optimal clearance between an end part of the lateral aligning guide and a stack of mailpieces registered against the wall.

BRIEF DESCRIPTION OF THE DRAWINGS

The invention will be more readily understood on reading the following description given by way of indication, with reference to the accompanying drawings, in which.

DESCRIPTION OF PREFERRED EMBODIMENT

Figure 1:
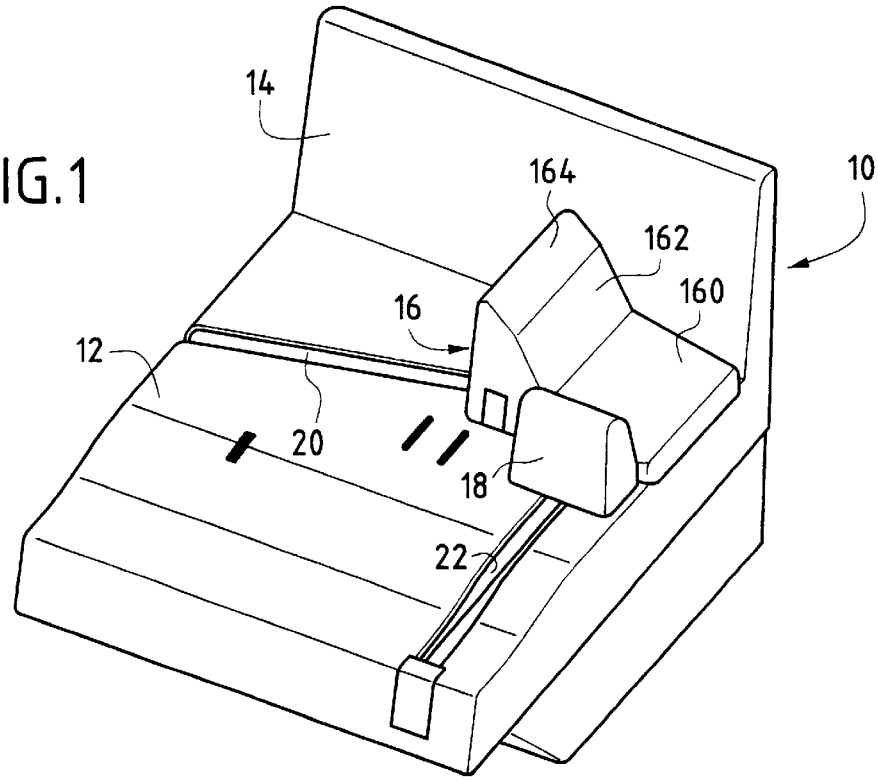
FIG. 1 shows in perspective an aligning device according to the invention in a first position of aligning.

Referring now to the drawings, FIG. 1 illustrates in perspective a module for receiving mailpieces from a document feeder of a mailing machine. This module 10 is arranged upstream of a selection module comprising rollers for gripping these mailpieces (cf. for example FIG. 3). It conventionally comprises a tray 12 on which the mailpieces are stacked, a registration wall 14 which closes one side of the tray and which defines a direction of advance for the mailpieces, and an aligning device for aligning the stack of mailpieces thus formed against the registration wall.

This aligning device comprises a first rear aligning guide 16 mobile in the direction of advance of the mailpieces and a second lateral aligning guide 18 mobile in a direction perpendicular to this direction of advance. Each aligning guide may be displaced in a respective groove 20, 22 made in the tray 10.

Figure 3:
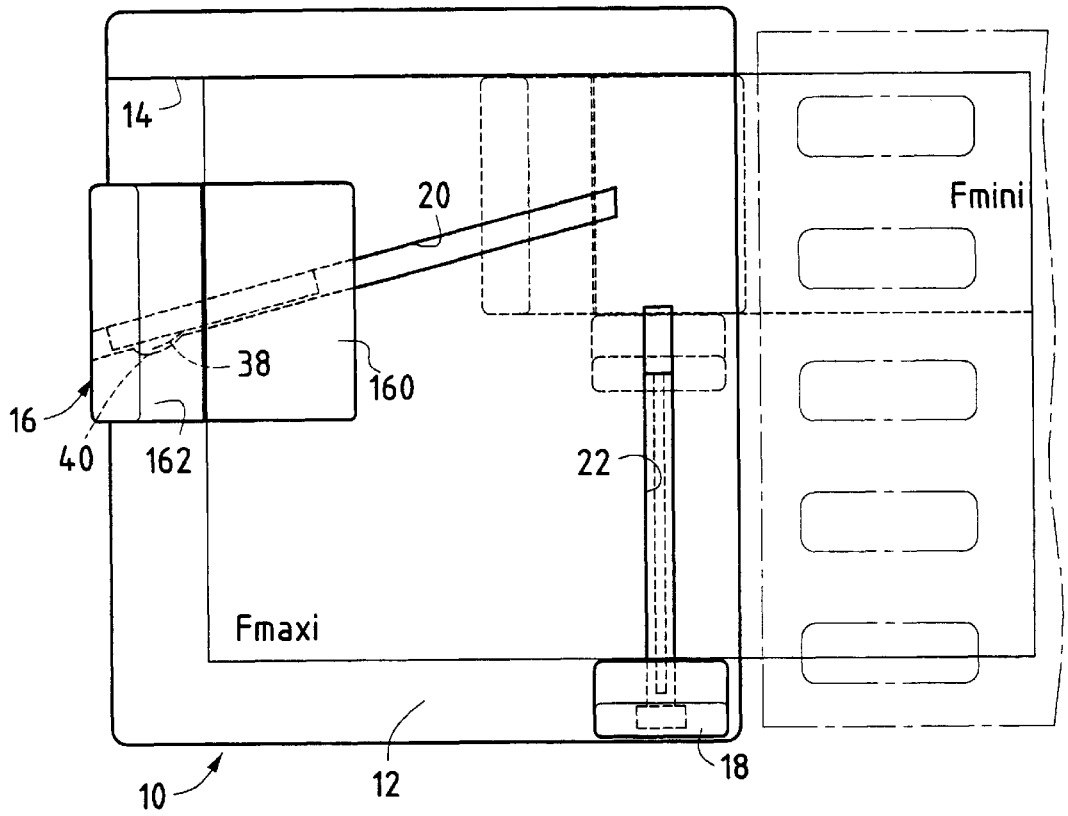
FIG. 3 is a plan view illustrating two end positions of the aligning device according to the invention.

According to the invention, the groove 20 of the rear aligning guide 16 is inclined with respect to the direction of advance of the mailpieces, by a determined angle $\alpha$ so that the rear aligning remains substantially centred on the small dimensions of the mailpieces, whatever their format (cf. in particular FIG. 3 which shows the positioning of these guides for a minimum format (Fmini) and a maximum format (Fmaxi) admissible by the device). The angle of inclination $\alpha$ of the groove is determined by proceeding as follows: Firstly, the space requirement volume of the rear aligning guide 16 is optimalized in the front extreme positions (with respect to the advance of the pieces) for rear and lateral alignment, corresponding to pieces of minimum format (F mini), then, from these extreme alignment positions, the different positions that the median part of the rear aligning guide can occupy, are respectively marked for different standardized formats of mailpieces, then the inclination $\alpha$ of the groove of the rear aligning guide is optimalized by tracing a line which passes as near as possible to all the afore-mentioned positions.

For European-standard formats of mailpieces, viz. from the format C4 "landscape" (325 mm×230 mm) to the visiting card format (140 mm×90 mm), via the format C6/5 (235 mm×114 mm), this angle is included within a range of 10 to 20°, and preferably from 15 to 20°.

These rear and lateral aligning guides present minimum volumes in order to occupy the extreme front aligning position of wedge one against the other, in their respective grooves, compatible with the minimum format (Fmini) admissible by the mailing machine, namely the visiting card format (position in broken lines in FIG. 3). In this way, the width of the rear aligning guide is preferably substantially equal to that of a visiting card.

The rear aligning guide 16 presents the shape of a wedge having at least two successive slopes, one 160 of slight inclination and the other 162 of steep inclination, procuring a suitable positioning of the stack of mailpieces and necessary for an efficient extraction of these pieces in front abutment, supported and raised at the rear, respectively for bundles of great and small thickness. This guide preferably presents the shape of a wedge having three successive slopes. Its upper part 164, of average inclination, serves to support the weight of the stack of pieces abutting thereon. Its median part 162, of steep inclination, decollates the stack and, like the upper part, enables the pieces to be maintained in front abutment in order to facilitate selection of the lower piece by the gripping rollers of the feeder. Its lower part 160, of slight inclination, so-called heel, makes it possible to maintain the efficiency of the selection. It continues to improve the extraction of the pieces as, when the stack "collapses" with a decreasing thickness, the pieces remain in front abutment with an angle of inclination which is reduced but conserved with respect to the receiving tray 12 and the selection rollers.

When the stack is large, only a limited number of pieces is in abutment on this heel, while almost all the weight of this stack is distributed over the upper part, this facilitating extraction of the lower pieces.

Figure 2:
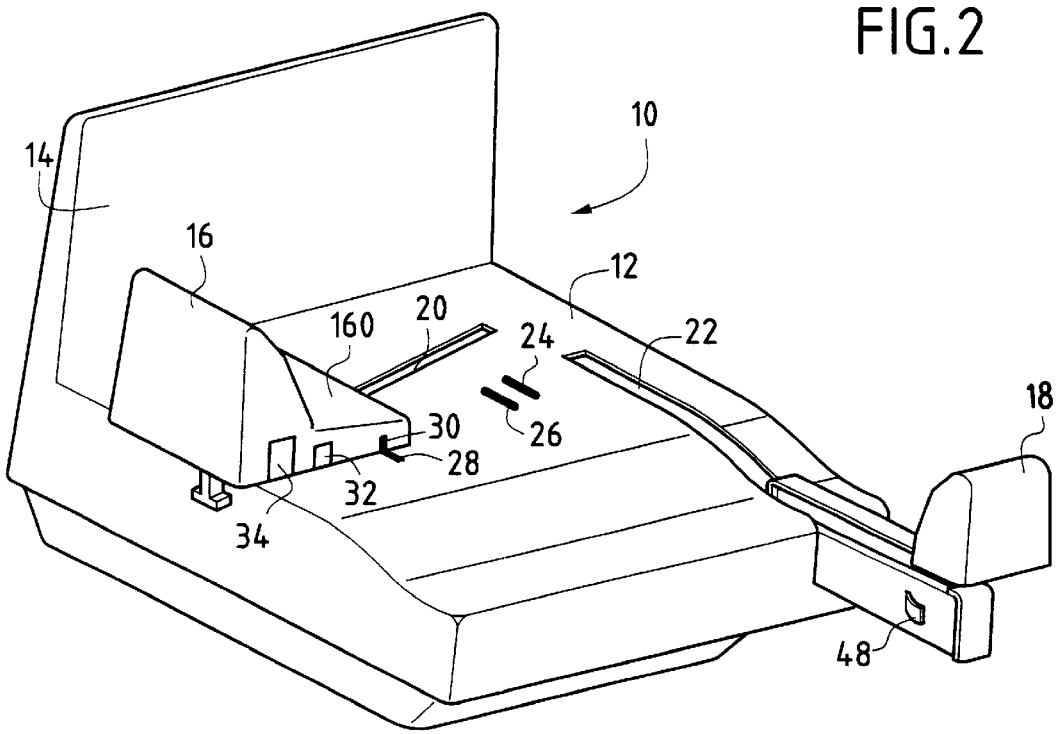
FIG. 2 shows in perspective an aligning device according to the invention in a second position of aligning.

According to another particularity of the invention, and as illustrated in FIG. 2, the receiving tray 12 comprises a plurality of engraved marks 24, 26, 28 capable of alignment with a mark 30 of the rear aligning guide 16, with a view to rapidly positioning the latter as a function of predetermined standard formats of mailpieces. The first mark 24 corresponds for example to a French format of type C6/5, the second mark 26 to an American format of type No. 10 (242 mm×105 mm), and the third mark 28 to a French format of type C4. This guide also comprises on its lateral face opposite the registration wall 14 two gauge labels 32, 34 which mark two threshold thicknesses of the mailpieces (for example 8 and 16 mm) corresponding to two operations of adjustment of the selection rollers located downstream and illustrated in FIG. 3. By this configuration of marking, a simple visual detection of thickness with respect to these two marked thresholds is sufficient to adjust the feeder in order to process batches of mailpieces in the corresponding range of thicknesses.

Figure 4:
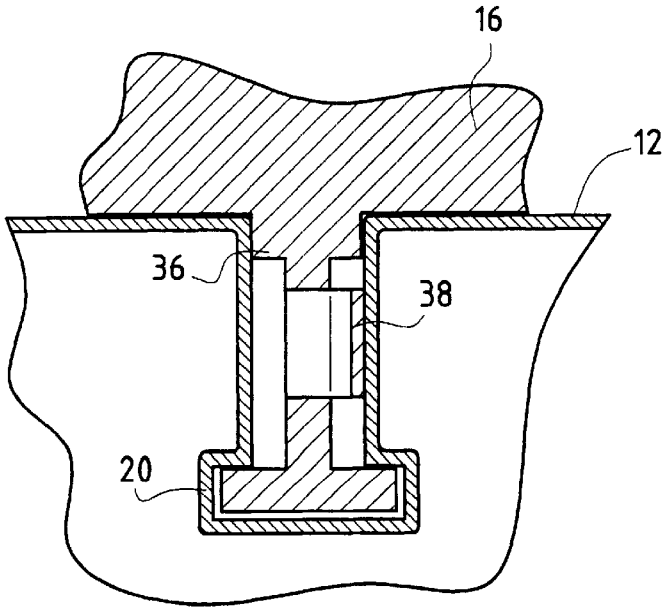
FIG. 4 is a view in section along plan IV—IV of FIG. 3.

FIG. 4 illustrates the means for displacement of the rear aligning guide 16 in its groove 20. To that end, the guide comprises a lower longitudinal member 36 in the form of an upturned T provided with at least one flexible lug or blade 38 and intended to slidably cooperate, with an appropriate clearance, with this groove of complementary shape. This elastic element which takes up this lateral clearance during slide may cooperate with a cavity 40 made in the groove 20 and intended to define a position of stop, substantially at the level of its open end, for the rear aligning guide.

Figure 6:
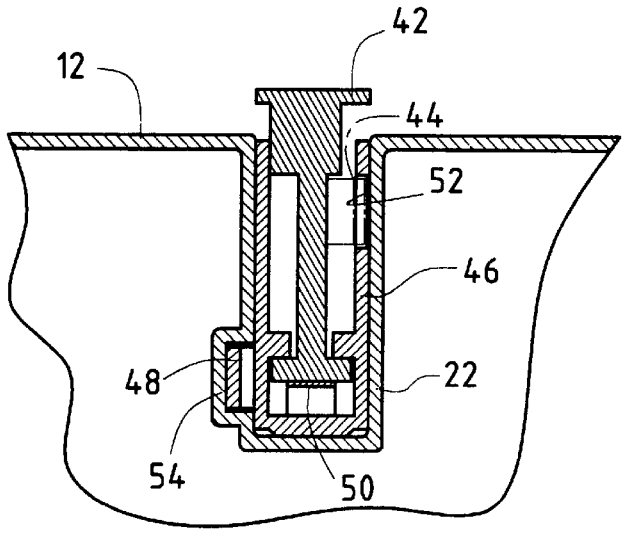
FIG. 6 is a view in section along plan VI—VI of FIG. 5.

The means for displacing the lateral aligning guide 18 in its groove 22 are illustrated in FIG. 6. This lateral guide comprises a lower longitudinal member 42 likewise in the form of an upturned T, and provided with at least one first flexible lug or blade 44, this longitudinal member being mounted on a U-shaped slideway 46 itself provided with at least one second flexible lug or blade 48 and in which it may slide, and which itself slides in the transverse groove 22 for lateral alignment. The first elastic element 44 takes up the lateral clearance during slide of the longitudinal member 42 in the slideway 46, the vertical clearance being taken up by a spring blade 50 placed on the bottom of this slideway. In addition, it cooperates with a first cavity 52 made in the slideway 46 and intended to define a position of stop of the longitudinal member, substantially at the level of the front end thereof (nearest the registration wall and corresponding to the blind end of the groove 22), for the lateral aligning guide. The second elastic element 48 takes up the lateral clearance during slide of the slideway 46 in the transverse groove 22. In addition, it cooperates with a second cavity 54 made in the groove 22 and intended to define a position of stop of the slideway, substantially at the level of the open end of the groove, for the lateral aligning guide. This second element is less elastic than the first elastic element 44 in order to allow a differential displacement of the longitudinal member and the groove. Intermediate stop positions may, of course, be envisaged, by multiplying the number of cavities.

Figure 5:
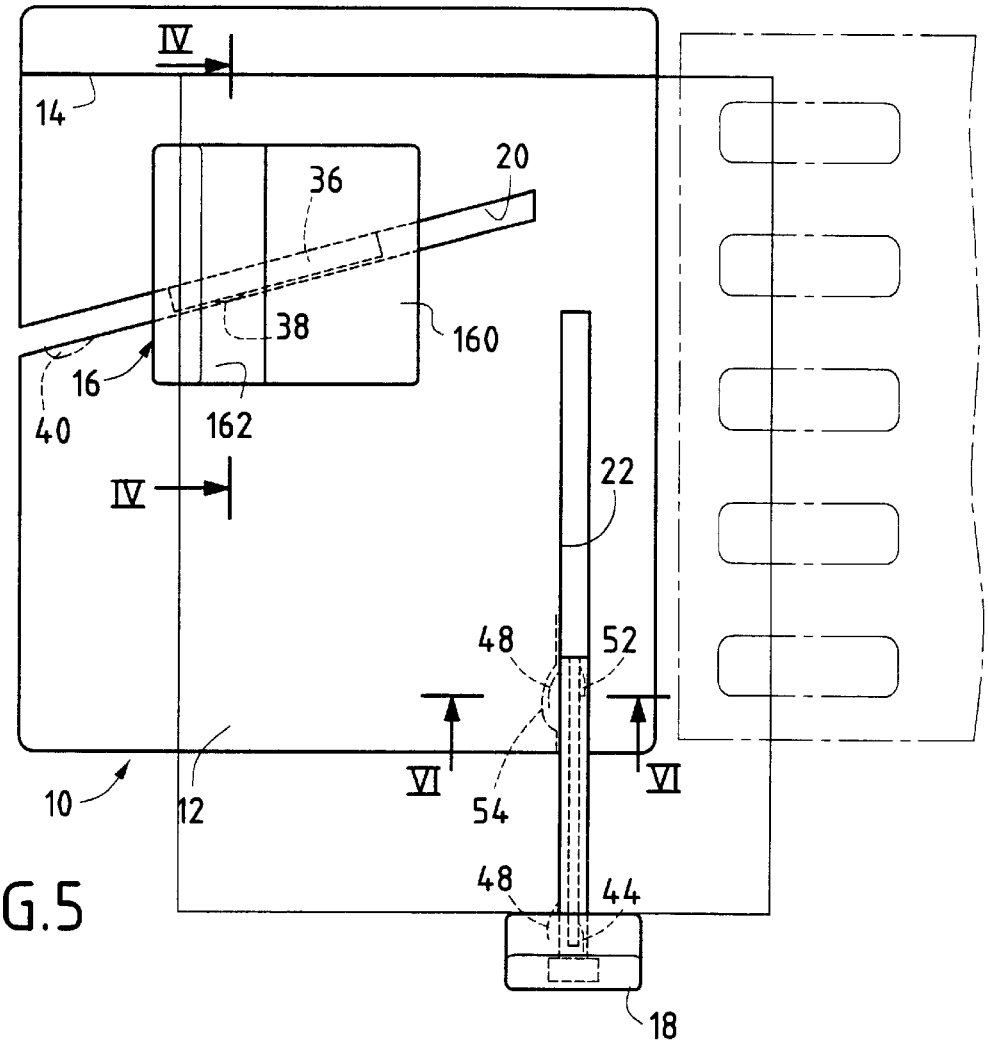
FIG. 5 is a plan view illustrating a particular, so-called "portrait" position of the aligning device according to the invention.

When the width of a mailpiece does not project beyond that of the tray 12, therefore remaining between the admissible minimum format Fmini and maximum format Fmaxi, only the longitudinal member 42 is urged to slide in the slideway 46, which is maintained in locking position in the lateral groove by the first blade 44 clipping in the first cavity 52. On the contrary, when the mailpiece of the maximum format admissible is rotated through 90° as illustrated in FIGS. 5 and 1, therefore with a transverse arrangement with respect to the direction of advance, in a configuration then known under the name of "portrait" mode, due to a lateral dimension of the mailpiece greater than that of the tray 12, it becomes necessary to cause the slideway 46 likewise to slide in order to extract it partially from the lateral groove 22. This is obtained simply by exerting a greater traction on the lateral aligning guide 18 (necessary for overcoming the resistance procured by the second elastic element whose elasticity is less than the first) so as to unclip this slideway 46.

An advantageous variant embodiment (not shown) consists in providing the lateral aligning guide 18 with a system for automatically adjusting its positioning as a function of the width of the mailpiece, by means for example of at least one position and/or pressure sensor fixed on the end part of the lateral aligning guide or on the tray, a control circuit and a drive motor. Pressure thresholds would make it possible to refine the alignment control, for example by moving this aligning guide back by some tenths of millimeters after having achieved a maximum threshold pressure authorized.

A more economical embodiment may comprise a system of calibrated springs for maintaining a substantially constant optimal bearing between the end part of the guide and the stack of pieces registered against the wall.

What is claimed is:

1. Aligning device for a feeder of a mailing machine, comprising:

a first rear aligning guide mobile in a direction of advance of the mailpieces, and a second lateral aligning guide mobile in a direction perpendicular to this direction of advance, each aligning guide being displaceable in a respective groove wherein the groove associated with said rear aligning guide is inclined by a determined angle $\alpha$ with respect to said direction of advance of the mailpieces, and wherein the rear aligning guide presents the shape of a wedge having at least two successive slopes, first slope of slight inclination and a second slope of steep inclination.

2. The aligning device of claim 1, wherein the rear aligning guide comprises three successive slopes with an additional slope of average intermediate inclination.

3. The aligning device of claim 1, wherein the rear aligning guide comprises a mark intended to be aligned with one of a plurality of marks previously engraved on the tray for receiving the mailpieces and each corresponding to a standard format of mailpieces.

4. The aligning device of claim 1, wherein the rear aligning guide comprises two gauge labels which mark two determined threshold thicknesses of the mailpieces each corresponding to a determined operation of adjustment of the feeder.

5. The aligning device of claim 1, wherein the rear aligning guide comprises a lower longitudinal member provided with at least one elastic element adapted to cooperate with a cavity made in the longitudinal groove so as to define a position of stop for this guide.

6. The aligning device of claim 1, wherein the lateral aligning guide slides in the groove associated therewith via a slideway.

7. The aligning device of claim 1, wherein said lateral aligning guide comprises a lower longitudinal member provided with at least one first elastic element adapted to cooperate with a cavity made in said slideway, so as to define a position of stop for this guide.

8. The aligning device of claim 6, wherein said slideway is provided with at least one second elastic element adapted to cooperate with a cavity made in the transverse groove, so as to define a position of stop for this slideway.

9. The aligning device of claim 7, wherein said slideway is provided with at least one second elastic element adapted to cooperate with a cavity made in the transverse groove, so as to define a position of stop for this slideway, and wherein the second elastic element presents less elasticity than the first elastic element.

10. Feeder for mailing machine comprising the aligning device of claim 1.

11. Aligning device for a feeder of a mailing machine, comprising:

a first rear aligning guide mobile in a direction of advance of the mailpieces, and a second lateral aligning guide mobile in a direction perpendicular to this direction of advance, each aligning guide being displaceable in a respective groove wherein the groove associated with said rear aligning guide is inclined by a determined angle $\alpha$ with respect to said direction of advance of the mailpieces, and wherein the rear aligning guide comprises a mark intended to be aligned with one of a plurality of marks previously engraved on the tray for receiving the mailpieces and each corresponding to a standard format of mailpieces.

12. Aligning device for a feeder of a mailing machine, comprising:

a first rear aligning guide mobile in a direction of advance of the mailpieces, and a second lateral aligning guide mobile in a direction perpendicular to this direction of advance, each aligning guide being displaceable in a respective groove wherein the groove associated with said rear aligning guide is inclined by a determined angle $\alpha$ with respect to said direction of advance of the mailpieces, and wherein the rear aligning guide comprises two gauge labels which mark two determined threshold thicknesses of the mailpieces each corresponding to a determined operation of adjustment of the feeder.

13. Aligning device for a feeder of a mailing machine, comprising:

a first rear aligning guide mobile in a direction of advance of the mailpieces, and a second lateral aligning guide mobile in a direction perpendicular to this direction of advance, each aligning guide being displaceable in a respective groove wherein the groove associated with said rear aligning guide is inclined by a determined angle $\alpha$ with respect to said direction of advance of the mailpieces, and wherein the rear aligning guide comprises a lower longitudinal member provided with at least one elastic element adapted to cooperate with a cavity made in the longitudinal groove so as to define a position of stop for this guide.

14. Aligning device for a feeder of a mailing machine, comprising:

a first rear aligning guide mobile in a direction of advance of the mailpieces, and a second lateral aligning guide mobile in a direction perpendicular to this direction of advance, each aligning guide being displaceable in a respective groove wherein the groove associated with said rear aligning guide is inclined by a determined angle $\alpha$ with respect to said direction of advance of the mailpieces, and wherein said lateral aligning guide comprises a lower longitudinal member provided with at least one first elastic element adapted to cooperate with a cavity made in said slideway, so as to define a position of stop for this guide.

15. Aligning device for a feeder of a mailing machine, comprising:

a first rear aligning guide mobile in a direction of advance of the mailpieces, and a second lateral aligning guide mobile in a direction perpendicular to this direction of advance, each aligning guide being displaceable in a respective groove wherein the groove associated with said rear aligning guide is inclined by a determined angle $\alpha$ with respect to said direction of advance of the mailpieces, wherein the later aligning guide slides in the groove associated therewith via a slideway, and wherein said slideway is provided with at least one second elastic element adapted to cooperate with a cavity made in the transverse groove, so as to define a position of stop for this slideway.

* * * * *